US009850846B1

(12) United States Patent
Qin

(10) Patent No.: US 9,850,846 B1
(45) Date of Patent: Dec. 26, 2017

(54) CYLINDER LINER AND METHOD OF FORMING THE SAME

(71) Applicant: ZYNP International Corp., Romulus, MI (US)

(72) Inventor: Xiaocai Qin, Romulus, MI (US)

(73) Assignee: ZYNP INTERNATIONAL CORP., Romulus, MI (US)

( * ) Notice: Subject to any disclaimer, the term of this patent is extended or adjusted under 35 U.S.C. 154(b) by 0 days.

(21) Appl. No.: 14/608,169

(22) Filed: Jan. 28, 2015

Related U.S. Application Data

(60) Provisional application No. 61/932,583, filed on Jan. 28, 2014.

(51) Int. Cl.

| | |
|---|---|
| ***B22C 3/00*** | (2006.01) |
| ***F02F 1/00*** | (2006.01) |
| ***C21D 9/08*** | (2006.01) |
| ***C21D 1/19*** | (2006.01) |
| ***C22C 38/16*** | (2006.01) |
| ***C22C 38/08*** | (2006.01) |
| ***C22C 38/04*** | (2006.01) |
| ***C22C 38/02*** | (2006.01) |
| ***C22C 38/00*** | (2006.01) |
| ***C22C 38/12*** | (2006.01) |

(52) U.S. Cl.
CPC ..... *F02F 1/004* (2013.01); *C21D 1/19* (2013.01); *C21D 9/08* (2013.01); *C22C 38/002* (2013.01); *C22C 38/02* (2013.01); *C22C 38/04* (2013.01); *C22C 38/08* (2013.01); *C22C 38/12* (2013.01); *C22C 38/16* (2013.01)

(58) Field of Classification Search
CPC ... F02F 1/004; C21D 9/08; C21D 1/19; C22C 38/16; C22C 38/12; C22C 38/02; C22C 38/002; C22C 38/08
USPC ..... 123/193.2
See application file for complete search history.

(56) References Cited

U.S. PATENT DOCUMENTS 4,767,278 A * 8/1988 Enderlein, Jr. ..... B63H 1/14 416/241 B
4,869,388 A * 9/1989 Race ..... C21C 1/10 220/501
4,880,477 A * 11/1989 Hayes ..... C21D 1/20 148/545
5,249,619 A * 10/1993 Meacock, II ..... B22D 27/20 164/58.1
5,887,646 A * 3/1999 Evans ..... B22D 1/007 164/349

(Continued)

FOREIGN PATENT DOCUMENTS

CN 103352163 A * 10/2013
DE 19629970 C1 3/1998
WO 2013026124 A1 2/2013

*Primary Examiner* — Marguerite McMahon
(74) *Attorney, Agent, or Firm* — Shumaker, Loop & Kendrick, LLP; Michael E. Dockins

(57) ABSTRACT

A high strength cast iron material for application in heavy duty diesel engines with Pa peak cylinder pressure greater than 240 bar is disclosed, the material a ductile material austempered to get a ausferrite matrix structure with higher mechanical properties than conventional cast iron materials available by using a designed low cost alloying cast material with heat treatment. Furthermore, the cylinder liner may be formed using novel heat treatment and/or fine honing processes to improve the properties thereof.

14 Claims, 4 Drawing Sheets

Comparison among cast iron grades (general properties)

| Structure/ Property | Pearlitic GCI | Bainitic GCI | CGI | DI | Inventive Alloy (ADI) | 1050 Steel |
|---|---|---|---|---|---|---|
| Graphite Form | Flake | Flake | Compacted (Vermicular) | Nodular (Spheroidal) | Nodular (Spheroidal) | Pearlitic |
| Matrix Structure | Pearlitic | As-cast Acicular Ferrite (Bainitic) | Pearlitic | Pearlitic | Austenite | Ferritic + Pearlitic |
| Hardness (HBN) | 200-280 | 270-360 | 200-240 | 230-280 | 300-400 | 200-230 |
| UTS (MPa) | 200-350 | 350-450 | 450-550 | 550-700 | 650-800 | 700-800 |
| Modulus of Elasticity (GPa) | 100-120 | 120-140 | 135-155 | 140-170 | 150-180 | 200-205 |
| Density (g/cm³) | 7.0-7.2 | 7.1-7.3 | 7.0-7.2 | 7.0-7.2 | 7.0-7.2 | 7.7-7.9 |
| Thermal Conductivity (W/mK) | 40-50 | 35-45 | 35-40 | 18-25 | 18-25 | 22-28 |
| Thermal Expansion Coefficient (um/mK) | 10-12 | 10-12 | 11-12 | 11-13 | 12-15 | 12-15 |

(56) References Cited

U.S. PATENT DOCUMENTS

| | | | | |
|---|---|---|---|---|
| 5,960,762 | A | 10/1999 | Imai | |
| 6,732,698 | B1 | 5/2004 | Bedwell et al. | |
| 8,317,942 | B2 * | 11/2012 | Pelsoeczy | C21D 5/00 148/321 |
| 2003/0007882 | A1 * | 1/2003 | Perrin | C22C 33/08 420/22 |
| 2010/0111662 | A1 * | 5/2010 | Larker | C21D 5/00 414/723 |
| 2011/0011070 | A1 * | 1/2011 | Logan | C22C 37/04 60/323 |
| 2011/0185993 | A1 * | 8/2011 | McKimpson | B22D 27/00 123/54.4 |
| 2011/0274946 | A1 * | 11/2011 | Severing | C21D 1/06 428/683 |
| 2012/0152413 | A1 * | 6/2012 | Parolini | B22D 13/023 148/539 |
| 2014/0208880 | A1 * | 7/2014 | Wu | F16H 55/12 74/434 |

* cited by examiner

Comparison among cast iron grades (general properties)

| Structure/ Property | Pearlitic GCI | Bainitic GCI | CGI | DI | Inventive Alloy (ADI) | 1050 Steel |
|---|---|---|---|---|---|---|
| Graphite Form | Flake | Flake | Compacted (Vermicular) | Nodular (Spheroidal) | Nodular (Spheroidal) | Pearlitic |
| Matrix Structure | Pearlitic | As-cast Acicular Ferrite (Bainitic) | Pearlitic | Pearlitic | Ausferrite | Ferritic + Pearlitic |
| Hardness (HBN) | 200-280 | 270-360 | 200-240 | 230-280 | 300-400 | 200-230 |
| UTS (MPa) | 200-350 | 350-450 | 450-550 | 550-700 | 650-800 | 700-800 |
| Modulus of Elasticity (GPa) | 100-120 | 120-140 | 135-155 | 140-170 | 150-180 | 200-205 |
| Density (g/cm$^3$) | 7.0-7.2 | 7.1-7.3 | 7.0-7.2 | 7.0-7.2 | 7.0-7.2 | 7.7-7.9 |
| Thermal Conductivity (W/mK) | 40-50 | 35-45 | 35-40 | 18-25 | 16-25 | 22-28 |
| Thermal Expansion Coefficient (um/mK) | 10-12 | 10-12 | 11-12 | 11-13 | 12-15 | 12-15 |

Fig. 1

Typical microstructure
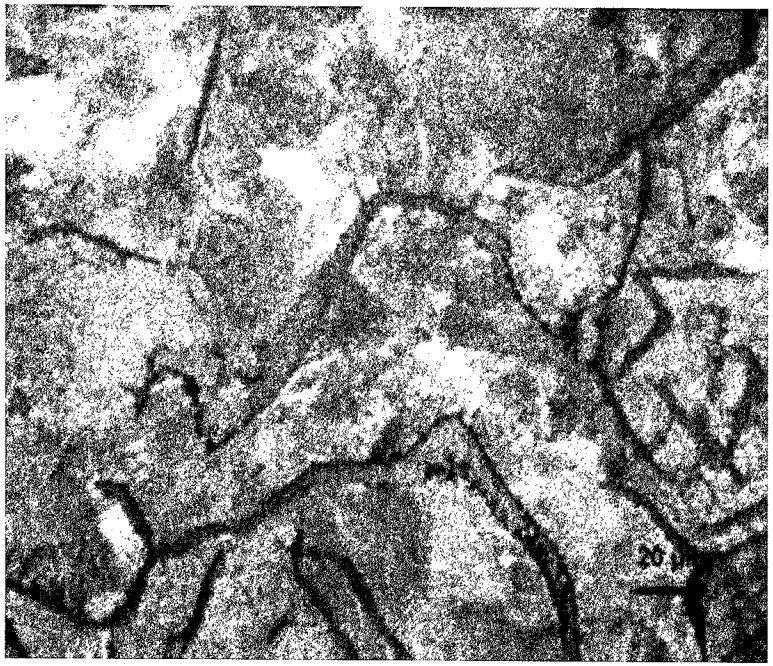
Pearlitic matrix with type- A graphite
2% Nital, 500x
ADI
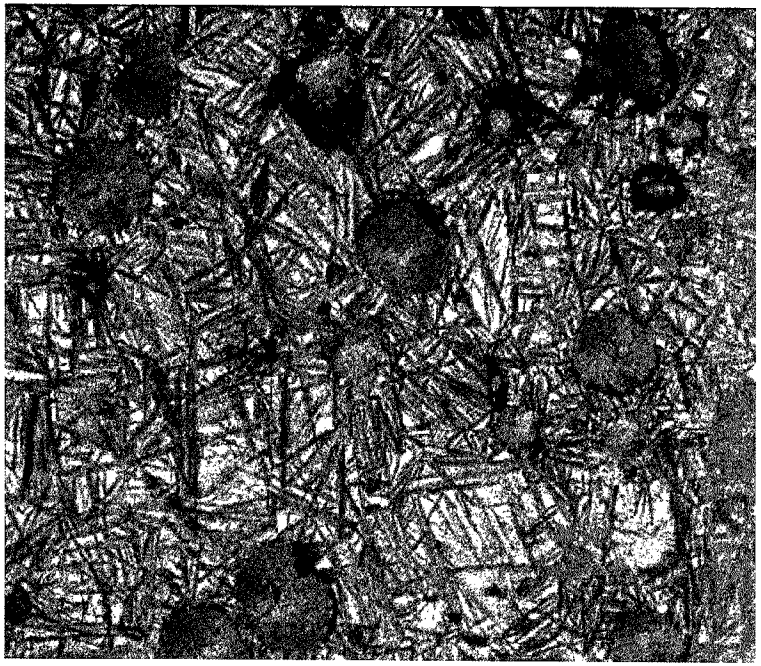
Austempered at 620° F (320 °C) for 60 min
Acicular ausferrite matrix, 2% Nital, 500x
Fig. 2

Comparison of chemical composition

| Element | Composition (wt%) | | | |
|---|---|---|---|---|
| | Gray Iron | Gray Iron | Ductile iron | Inventive Alloy |
| | Pearlitic | Bainitic | Pearlitic | (ADI) |
| Carbon | 3.02 | 2.83 | 3.62 | 3.62 |
| Silicon | 1.85 | 2.12 | 2.36 | 2.36 |
| Manganese | 0.85 | 0.46 | 0.49 | 0.49 |
| Phosphorus | 0.22 | 0.047 | 0.027 | 0.027 |
| Sulfur | 0.05 | 0.036 | 0.02 | 0.02 |
| Copper | - | 0.36 | 0.87 | 0.87 |
| Nickel | 0.85 | 1.24 | 0.34 | 0.34 |
| Chromium | 0.24 | - | - | - |
| Molybdenum | 0.35 | 0.82 | 0.14 | 0.14 |

Fig. 3

CYLINDER LINER AND METHOD OF FORMING THE SAME

CROSS-REFERENCE TO RELATED APPLICATION

This application claims the benefit of priority of U.S. Provisional Patent Application Ser. No. 61/932,583 filed on Jan. 28, 2014 hereby incorporated herein by reference in its entirety.

FIELD OF THE INVENTION

The present invention relates to cylinder liners and, more particularly, to a cylinder liner for internal diesel combustion engines and methods for processing of the same.

BACKGROUND OF THE INVENTION

Cylinder liners for internal combustion engines consist predominantly of gray cast iron alloys with lamellar graphitization embedded in pearlitic microstructure. In particular after the introduction of new technologies as exhaust gas recirculation (EGR), it was observed an increase on the demand of diesel engines. This growth is surrounded by requirements such as: less fuel consumption, emissions reduction, and larger power output and torque. Improved performance, as operation efficiency and engine power density are being achieved by the rise of combustion chamber pressures, particularly for diesel engines. For diesel passenger cars, peak firing pressures in excess of 160 bar or 180 bar can be expected. Heavy-duty truck engines are expected to achieve peak cylinder pressures (PCP) up to 240 bar.

It would be desirable to develop a cylinder liner formed from an alloy and/or made from a more efficient process that increases the materials and reliability thereof.

SUMMARY OF THE INVENTION

Concordant and congruous with the present invention, a cylinder liner formed from an alloy and/or made from a more efficient process that increases the materials and reliability thereof has surprisingly been discovered.

According to an embodiment of the invention, a cylinder liner comprises a sidewall formed from a microstructure comprising ausferrite and nodular graphite.

According to another embodiment of the invention, a cylinder liner comprises a sidewall formed from a microstructure comprising ausferrite and nodular graphite, the sidewall consisting essentially of: between about 3.55 wt % and about 3.65 wt % C, between about 2.30 wt % and about 2.40 wt % Si, between about 0.45 wt % and about 0.50 wt % Mn, between about 0.020 wt % and about 0.030 wt % P, between about 0.15 wt % and about 0.25 wt % S, between about 0.80 wt % and about 0.90 wt % Cu, between about 0.30 wt % and about 0.40 wt % Ni, between about 0.10 wt % and about 0.20 wt % Mo, and between about 0.005% and about 0.06% Mg.

According to another embodiment of the invention,

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a tabular comparison of the general properties among prior art grades of cast iron, including ADI, the material according to an embodiment of the present invention;

FIG. 2 is a magnified photograph of a prior art material as compared to that of the ADI material according to the embodiment of the invention;

FIG. 3 is a tabular comparison of the chemical composition of prior art materials as compared to the ADI material according to the embodiment of the invention;

DETAILED DESCRIPTION OF EXEMPLARY EMBODIMENTS OF THE INVENTION

Figure 5:
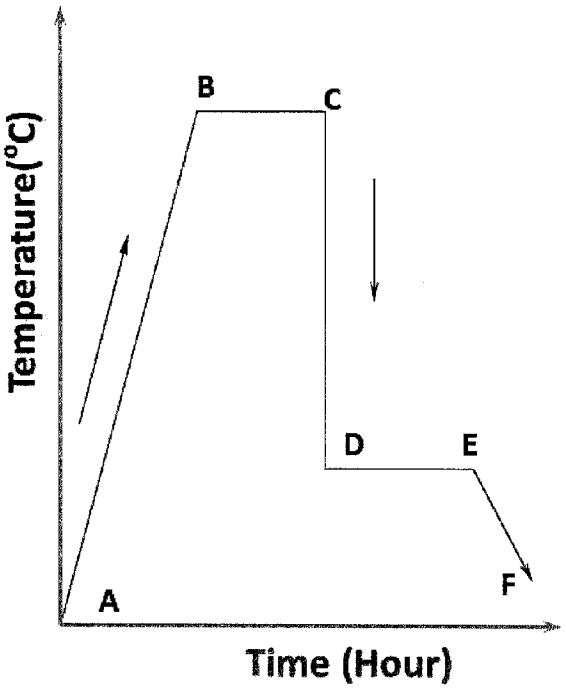
FIG. 5 is a graph of temperature versus time for a heat treatment process to form the ADI material according to embodiment of the invention.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical. It is further understood that the methods disclosed herein may be employed together or separately to form a cylinder liner using the novel materials and formulations described herein.

According to an embodiment of the invention, a cylinder liner is formed from a novel material using a novel formation process. The spheroidal (ductile iron) graphite morphology particles embedded in an austempered structure appear to have the potential to improve material capacity with regard important physical properties such as tensile strength, stiffness, and fatigue strength that is improved over conventional gray cast iron material. Consequently the novel cylinder liner may have a reduced wall thickness as compared to conventionally formed cylinder liners with an increasing power density for engines the novel cylinder liner is used therein.

The novel cylinder liner incorporates avoids the formation of graphite flakes and graphite in the form of veins knowing that an increase in an amount of magnesium fosters the reduction thereof. By increasing magnesium, nodular graphite particles are formed. This graphite morphology is elongated and randomly oriented as in gray iron; however the nodular graphite particles have rounded edges to inhibit crack initiation and growth and is the source of the improved mechanical properties in the novel cylinder liner, as compared to gray iron. Magnesium may be present in an amount of about 0.005% to about 0.06% by weight to get the desired nodularity. More than 0.06% by weight magnesium may be used, as desired As the nodularity increases, the strength and stiffness of the novel cylinder liner also increases.

This novel cylinder liner includes a microstructure made of ausferrite and nodular graphite. Ausferrite is a combination of high carbon enriched metastable austenite plus acicular ferrite. This unique microstructure imparts the cylinder liner (austempered ductile iron) ADI with a yield strength up to 730 MPa, UTS 850-900 MPa, 5-10% elongation, 290-340 HB, plus improved fatigue, wear and cavitation resistance. The microstructure includes graphite- Nodular (Form 1) >80%, nodule size-class 6-7 (20-30 um) and matrix-acicular ausferrite.

FIG. 1 shows a tabular comparison of the general properties among the various grades of cast iron, including the novel ADI, the material used to form the cylinder liner according to the present invention. FIG. 2 shows a typical microstructure of a prior art material, a material having a pearlitic matrix, at 500× magnification in a side-by-side comparison of the ADI material at 500× magnification. FIG. 3 is a tabular comparison of the chemical composition of known alloys as compared to the material according to an embodiment of the invention. The inventive alloy (ADI) is formed from the following materials in wt %: C—between about 3.55% and about 3.65% and preferably about 3.62%, Si—between about 2.30% and about 2.40% and preferably about 2.36%, Mn—between about 0.45% and about 0.50% and preferably about 0.49%, P—between about 0.020% and about 0.030% and preferably about 0.27%, S—between about 0.15% and about 0.25% and preferably about 0.20%, Cu—between about 0.80% and about 0.90% and preferably about 0.87%, Ni—between about 0.30% and about 0.40% and preferably about 0.34%, Mo—between about 0.10% and about 0.20% and preferably about 0.14%, Mg—between about 0.005% and about 0.06%, and substantially free from Cr.

Figure 4:
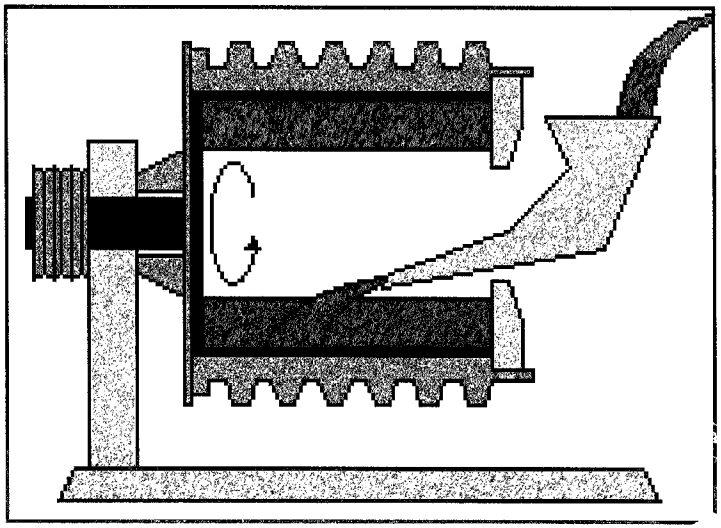
FIG. 4 is a drawing of a centrifugal casting apparatus used in a method according to an embodiment of the invention to form a cylinder liner using the material described herein and/or shown in FIGS. 1-3.

According to another embodiment of the invention, a process for forming the ADI cylinder liner as described hereinabove using a device shown in FIG. 4 is as follows:

1. A mold is set up and rotated along a horizontal (1000-1700 rpm) axis.
2. The mold is coated with a refractory coating.
3. While rotating, molten metal having a desired composition is formed.
4. The metal that is poured in will then distribute itself over the rotating wall.
5. During cooling lower density impurities will tend to rise towards the center of rotation.
6. After the part has solidified, it is removed.

The process of forming the ADI cylinder liner further undergoes a heat treatment as shown in FIG. 5. FIG. 5 illustrates a graph of temperature versus time for the heat treatment of the novel cylinder liner formed from the ADI materials disclosed herein according to another embodiment of the invention. The formed cylinder liner is heated to a temperature up to from about 850° C. to about 900° C. over a desired period of time (line A-B). The ductile iron is austenized at the temperature from about 850° C. to about 900° C. for a desired amount of time (line B-C). During the austenizing step, the temperature may be kept substantially constant or may vary within ±15° C., as desired. The length of time for the austenizing step will vary based on the thickness and size of the cylinder liner. This time period may be calculated by one of ordinary skill in the art. The austenized ductile iron is then cooled via a quenching step in a bath such as a salt bath (line C-D). The cylinder liner is cooled in the bath to a temperature from about 375° C. to about 400° C. whereby the material forming the cylinder liner is austempered (line D-E). Metallurgical reactions occurring during the austempering step:

$$\gamma \rightarrow \alpha + \gamma_{HC}$$

$$\gamma_{HC} \rightarrow \alpha + \epsilon$$

After the austempering step, the austempered material is further cooled to ambient temperature to obtain the ADI material described herein (line E-F). Prior to the heat treatment step or after the heat treatment step, as desired, the cylinder liner may be honed and otherwise machined. One process for honing and the resultant surface specifications of the cylinder liner that may be utilized for the ADI alloy described herein is disclosed in commonly-owned U.S. Provisional Patent Application Ser. No. 61/932,583 filed on Jan. 28, 2014 and a commonly-owned U.S. Pat. No. 9,581,103 filed on Jan. 28, 2015 that claims the benefit of the earlier filing date of the '583 application, each of which is incorporated herein by reference in their entirety.

The object is appropriate for the instant invention at the basis to also find a cast iron alloy for high demand engines (PCP greater than about 240 bar) as a result of mechanical properties improvements. The benefits of the invention over known alloys include:

- Wall thickness ratio 3:2 (higher output for existing engine block or new downsized engines)
- Higher cavitation-erosion resistance (due to high modulus of elasticity)
- Higher selective corrosion resistance (discontinued graphite)
- Best solution for scraper ring design (due to high mechanical properties)
- Thermal conductivity ratio 2:1 (possible slight increasing of temperature for a better engine thermal efficiency).
- Reduction in weight of machined cylinder liner
- Reduction in overall weight of the finished engine From the foregoing description, one ordinarily skilled in the art can easily ascertain the essential characteristics of this invention and, without departing from the spirit and scope thereof, can make various changes and modifications to the invention to adapt it to various usages and conditions.

I claim:

1. A cylinder liner comprising:

an inner sidewall formed from a microstructure comprising ausferrite, nodular graphite, between about 3.55 wt % and about 3.65 wt % C, and between about 0.005% and about 0.06% Mg, wherein the microstructure includes graphite-nodular (form I) >80%, nodule size class 6-7 (20-30 μm), and matrix-acicular ausferrite.

2. The cylinder liner of claim 1, wherein the ausferrite of the sidewall is formed from a combination of high carbon enriched metastable austenite plus acicular ferrite.

3. The cylinder liner of claim 1, wherein the sidewall is substantially free from flake graphite.

4. The cylinder liner of claim 1, wherein the sidewall includes between about 2.30 wt % and about 2.40 wt % Si.

5. The cylinder liner of claim 4, wherein the sidewall includes between about 0.45 wt % and about 0.50 wt % Mn.

6. The cylinder liner of claim 5, wherein the sidewall includes between about 0.020 wt % and about 0.030 wt % P.

7. The cylinder liner of claim 6, wherein the sidewall includes between about 0.15 wt % and about 0.25 wt % S.

8. The cylinder liner of claim 7, wherein the sidewall includes between about 0.80 wt % and about 0.90 wt % Cu.

9. The cylinder liner of claim 8, wherein the sidewall includes between about 0.30 wt % and about 0.40 wt % Ni.

10. The cylinder liner of claim 9, wherein the sidewall includes between about 0.10 qt % and about 0.20 wt % Mo.

11. The cylinder liner of claim 10, wherein the sidewall includes between about 0.005 wt % and about 0.06 wt %.

12. The cylinder liner of claim 11, wherein the sidewall is substantially free from Cr.

13. The cylinder liner of claim 12, wherein the sidewall includes about 3.62 wt % C, about 2.36 wt % Si, about 0.49 wt % Mn, about 0.27 wt % P, about 0.20 wt % S, about 0.87 wt % Cu, about 0.34 wt % Ni, and about 0.14 wt % Mo.

14. A cylinder liner comprising:

a sidewall formed from a microstructure comprising ausferrite and nodular graphite, wherein the microstructure includes graphite-nodular (form I) >80%, nodule size class 6-7 (20-30 μm), and matrix-acicular ausferrite, the sidewall consisting essentially of:

between about 3.55 wt % and about 3.65 wt % C, between about 2.30 wt % and about 2.40 wt % Si, between about 0.45 wt % and about 0.50 wt % Mn, between about 0.020 wt % and about 0.030 wt % P, between about 0.15 wt % and about 0.25 wt % S, between about 0.80 wt % and about 0.90 wt % Cu, between about 0.30 wt % and about 0.40 wt % Ni, between about 0.10 wt % and about 0.20 wt % Mo, and between about 0.005% and about 0.06% Mg.

* * * * *